US009404329B2

(12) United States Patent
Meeks

(10) Patent No.: US 9,404,329 B2
(45) Date of Patent: Aug. 2, 2016

(54) DOWNHOLE TOOL FOR DEBRIS REMOVAL

(71) Applicant: Weatherford Technology Holdings, LLC, Houston, TX (US)

(72) Inventor: Arthur Warren Meeks, Porter, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 304 days.

(21) Appl. No.: 13/839,632

(22) Filed: Mar. 15, 2013

(65) Prior Publication Data

US 2014/0262277 A1 Sep. 18, 2014

(51) Int. Cl.

| | |
|---|---|
| ***E21B 37/02*** | (2006.01) |
| ***E21B 23/00*** | (2006.01) |
| ***E21B 37/00*** | (2006.01) |
| ***E21B 10/32*** | (2006.01) |

(52) U.S. Cl.

CPC ..... *E21B 23/006* (2013.01); *E21B 10/325* (2013.01); *E21B 37/00* (2013.01)

(58) Field of Classification Search

USPC ..... 166/170, 173, 311, 174

See application file for complete search history.

(56) References Cited

U.S. PATENT DOCUMENTS

| | | | | |
|---|---|---|---|---|
| 3,105,555 | A * | 10/1963 | Villalon, Jr. | E21B 37/02 15/104.16 |
| 7,143,847 | B2 | 12/2006 | Pia | |
| 2004/0222022 | A1 | 11/2004 | Nevlud et al. | |
| 2005/0028982 | A1 | 2/2005 | Howlett et al. | |
| 2007/0017679 | A1* | 1/2007 | Wolf et al. | 166/312 |
| 2009/0025927 | A1 | 1/2009 | Telfer | |
| 2009/0218092 | A1* | 9/2009 | Booth | E21B 37/02 166/174 |
| 2011/0214873 | A1 | 9/2011 | Krieg et al. | |
| 2011/0284233 | A1 | 11/2011 | Wu et al. | |
| 2014/0102797 | A1* | 4/2014 | Mahajan et al. | 175/57 |

FOREIGN PATENT DOCUMENTS

WO 9316833 A1 9/1993

OTHER PUBLICATIONS

PCT International Search Report and Written Opinion dated Mar. 19, 2015, for International Application No. PCT/US2014/025416.

* cited by examiner

*Primary Examiner* — Sunil Singh

(74) *Attorney, Agent, or Firm* — Patterson & Sheridan, LLP

(57) ABSTRACT

A downhole tool for use in a wellbore having a tool body with a blade assembly slidably mounted thereon and movable between a retracted and an outwardly extended position. The blade assembly is biased towards the retracted position and movable with an actuating force to the extended position. The tool includes an indexer constructed and arranged to facilitate movement of the blade assembly.

27 Claims, 11 Drawing Sheets

DOWNHOLE TOOL FOR DEBRIS REMOVAL

BACKGROUND OF THE INVENTION

1. Field of the Invention

Embodiments of the present invention generally relate to a downhole tool for debris removal.

2. Description of the Related Art

Wellbores are formed one section at a time with each section typically lined with a string of tubulars (casing or liner) which are cemented in place before a subsequent, smaller diameter length of wellbore is drilled. The cementing process consists of pumping a curable material down the wellbore and circulating it back up an annular area formed between the new tubular string and the earthen bore around it. When lower sections of tubulars are cemented, there is typically cement residue left at an upper end of the string where it can cure and interfere with later operations. Debris removal tools typically have extendable arms or blades and are run into the wellbore on a work string. Once remotely actuated, the tools are rotated and/or reciprocated in order to remove debris from an upper end of the newly cemented string and from an interior of the lager diameter tubular thereabove. Prior art debris removal tools are unreliable. In one instance, friction between the blades and the debris or the wellbore walls, especially in non-vertical wellbores, can cause at least one blade to prematurely retract while in use. In most cases, an operator at the surface of the well is unaware of the malfunction. In other cases, the tools are removed in an extended position, risking damage to a tubular string therearound as the work string and tool are rotated.

What is needed is a debris removal tool for use in a wellbore that is more reliable.

SUMMARY OF THE INVENTION

The present invention generally relates to a downhole tool for use in a wellbore having a tool body with a blade assembly slidably mounted thereon and movable between a retracted and an outwardly extended position. The blade assembly is biased towards the retracted position and movable with an actuating force to the extended position. The tool includes an indexer constructed and arranged to facilitate the movement of the blade assembly. In one embodiment, the blade assembly is unitary and in another embodiment the tool includes a signaling arrangement to notify an operator when the tool has been shifted between positions.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to a debris removal tool for use in a wellbore.

As used herein, the terms "down," "up," "downward," "upward," "lower," "upper" and other directional references are relative and are used for reference only. Also, the terms "blade assembly" and "blades" are used interchangeably to simplify explanations. U.S. Pat. No. 7,143,847 and Patent Application Nos. 2009/0025927 and 2009/0218092 disclose downhole tools for debris removal and those are incorporated herein in their entirety.

Figure 1A:
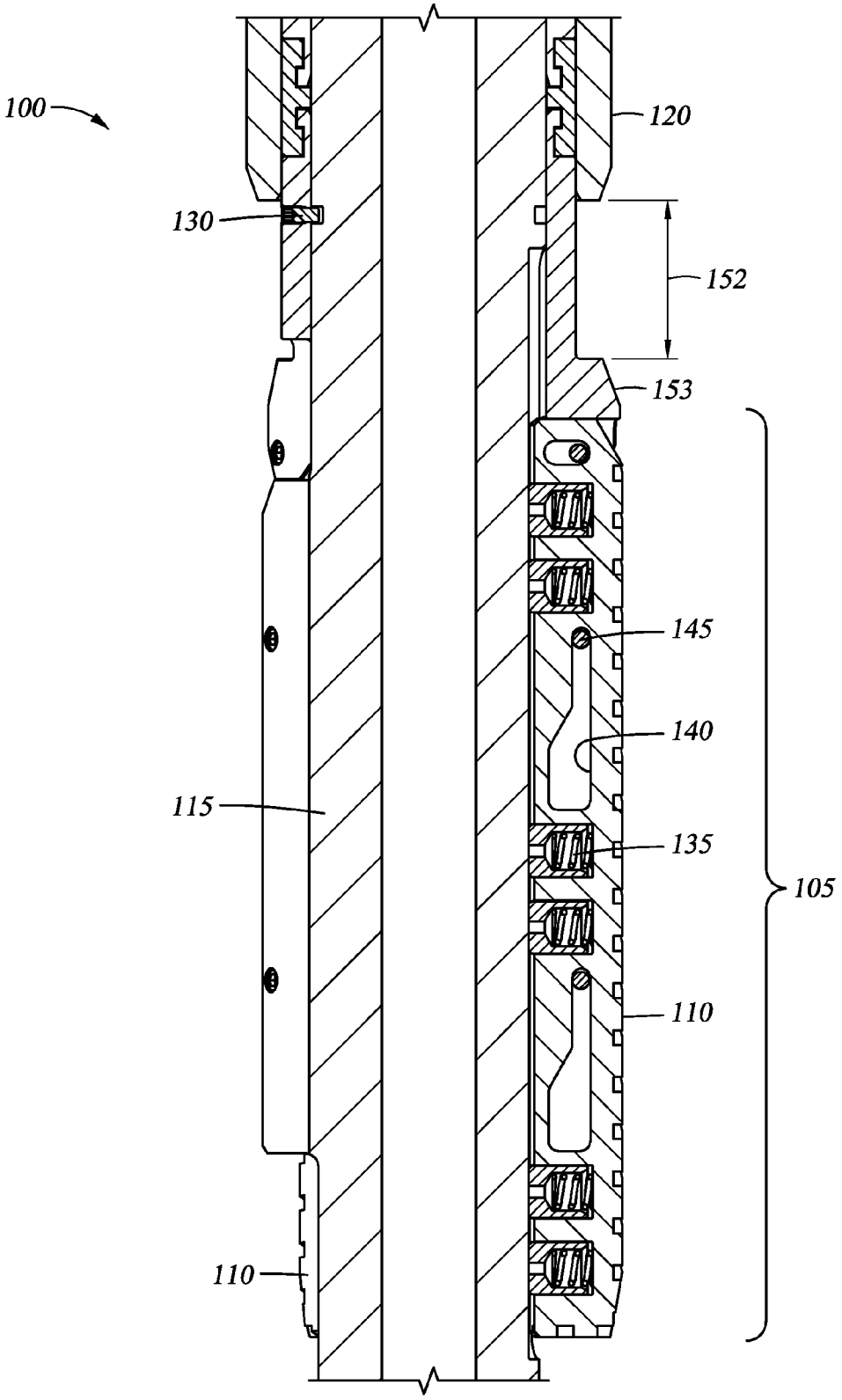
FIG. 1A is a partial section view of a lower end of a tool in a run-in position and FIG. 1B, C are views of an upper portion thereof.

FIG. 1A is a section view of a lower portion of a tool 100 in a run-in position. The tool 100 includes a blade assembly 105 typically including three blades 110, radially spaced around a body 115. The blade assembly 105 is movable relative to the body 115 of the tool and also movable relative to an outer housing 120. In the embodiment shown, the blade assembly 105 is unitary, whereby all blades 110 move together between the various positions of the tool. The blade assembly 105 is shown in its run-in (retracted) position and is retained in that position by a spring 125 (visible in FIG. 2B, C) that biases the blade assembly downward relative to the body 115 and outer housing 120 and also by a shearable pin 130 that prevents the tool 100 from becoming actuated during run-in. The unitary nature of the blade assembly permits a single pin to be used to hold the assembly in place during run-in. Because the pin can be more robust that individual pins for each blade, there is less chance of the tool shifting during run-in. In the run-in position shown in FIG. 2A, the blades 110 are held adjacent the body 115 of the tool due to profiles 140 formed in the blade and pins 145 associated with the body. Each blade 110 is individually biased towards an outwardly extended position by springs 135 and when the tool is shifted, the pins 145 are moved to a different location in the profiles 140 permitting the springs to move the blades outwardly. Upward movement of the blade assembly to the outwardly extended position is limited by the length of a gap 152 that is formed between a leg of an L-shaped member 153 and a lower end of the housing 120.

Figure 2A:
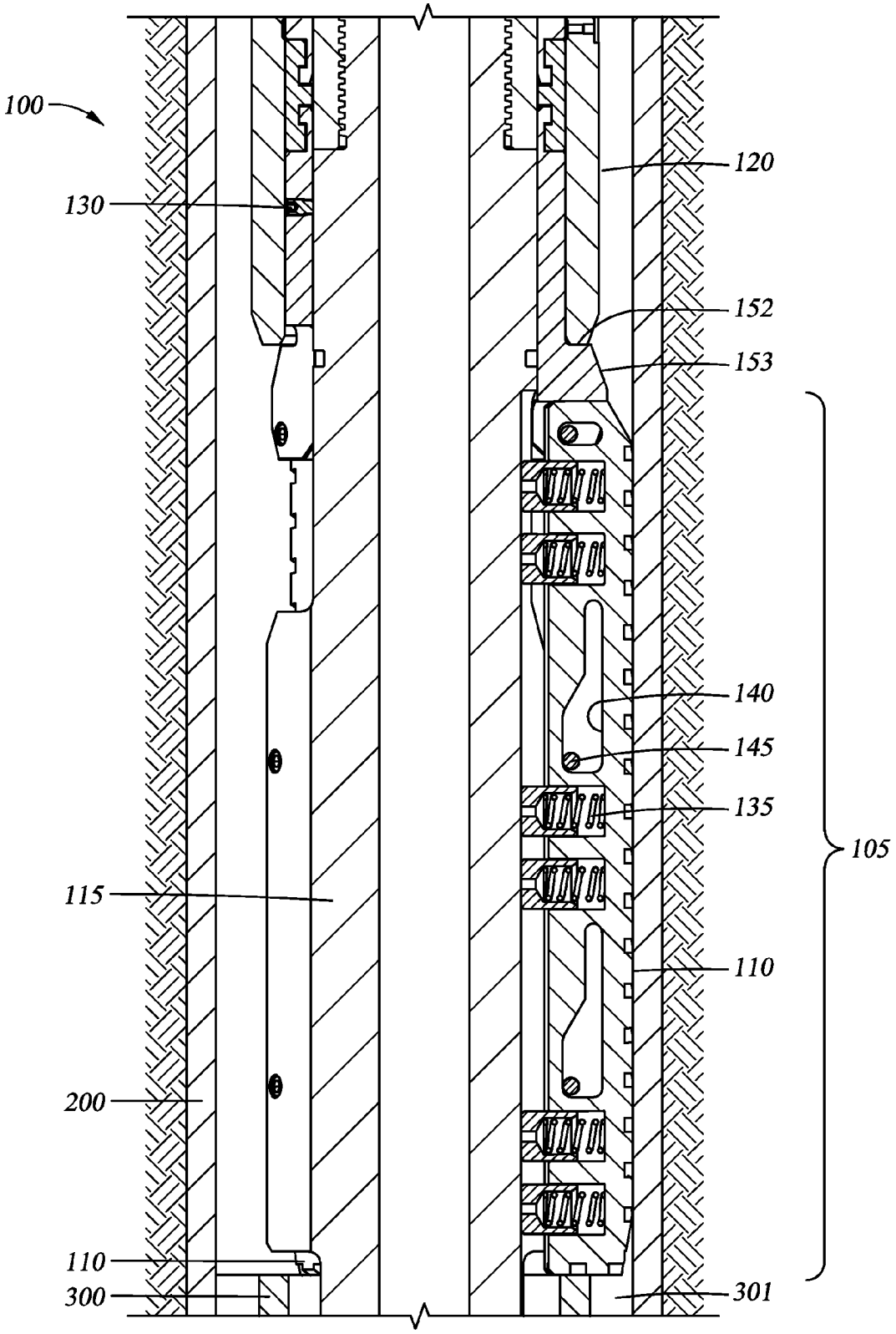
FIG. 2 A is a partial section view of a lower end of the tool of FIG. 1 in an actuation position and FIG. 2 B, C are views of an upper portion thereof.

The tool 100 is shifted to its outwardly extended position (and back to its run-in position) by the generation of an actuating force between a lower end of the blade assembly 105 and a stationary object in the wellbore, like an upper end of a tubular or polished bore receptacle (FIG. 2A). The tool is constructed and arranged whereby an outer diameter of the blade assembly 105 is greater than the inner diameter of the tubular while the outer diameter of the tool body 115 is smaller than the inner diameter of the tubular. In this manner, the body 115 of the tool can extend into an inner diameter of the stationary tubular while the blade assembly 105 is retained at an upper end of the tubular and can be moved towards its outwardly extended position. As the tool 100 is actuated a first time, the shear pin 130 is fractured, permitting the blade assembly 105 to move against the biasing force of the spring 125.

Figure 1B:
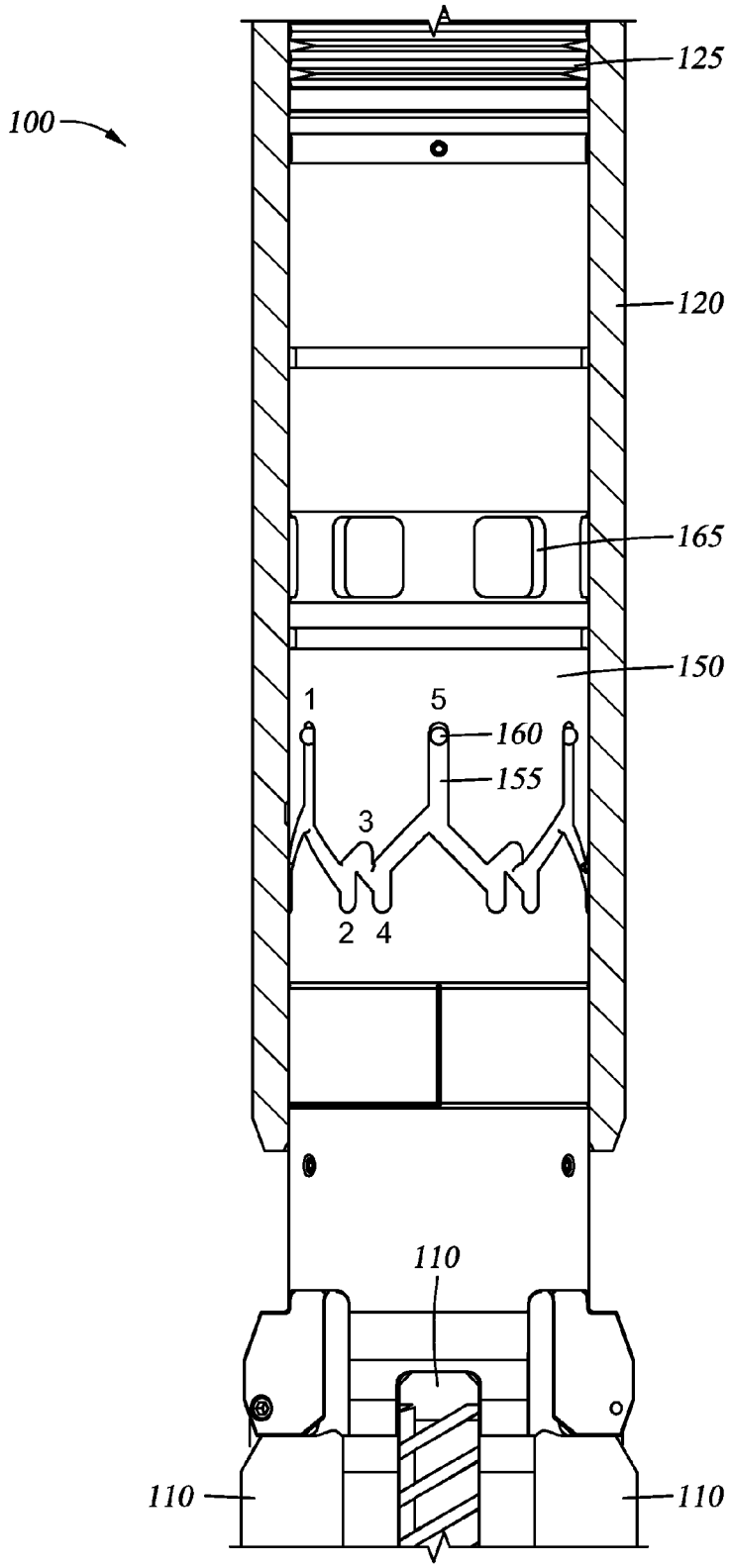

The tool is intended to be shifted between positions by the actuating force described above and the position of the blades and blade assembly 105 is determined and managed by an indexer 150 that is illustrated in FIG. 1B, C. Like the blade assembly, the indexer 150 is arranged around the body 115 of the tool 100 and moves with the blade assembly independent of the body and outer housing 120. The indexer 150 includes a continuous groove 155 formed around its perimeter and operates with a set of inwardly facing balls 160 that are radially disposed around an interior of the housing 120 and retained in the grove 155. In the run-in position shown in FIG. 1B, the balls are retained at a location "1" in the groove.

In addition to the indexer 150, the tool illustrated includes a signaling arrangement to notify an operator at the surface of the well of the position of the tool. Still referring to FIG. 1B, C, the signaling arrangement in the embodiment shown includes windows 165 formed around the indexer 150, ports 170 formed in the body 115 and corresponding ports 175 formed in the outer housing 120 of the tool. The ports 170, 175 and windows 165, when aligned, permit fluid communication between a central bore 180 of the tool and an annulus between the tool and casing therearound (not shown). For example, the ports 170, 175 and windows 165 are constructed and arranged to align when the tool is moved from the run-in position to the actuation or operational positions shown in FIGS. 2A-C, 3A-C. In this manner, a shift of the tool 100 from the run-in position will result in a change in pressure, noticeable at the surface of the well, as the windows and ports align and fluid from the bore of the body is permitted to escape to the annulus. The ports can be sized depending on the flow rate of fluid through a work string and the desired pressure drop. In one example, fluid is pumped at 600 gallons per minute (GPM) and a drill bit at the lower end of the string creates a fluid pressure of 1000 psi in the string. The ports can be sized so that when they are aligned with the windows of the indexer, a pressure drop of 20% takes place, resulting in a drop of pressure at the surface from 1000 to 800 psi.

Figure 1C:
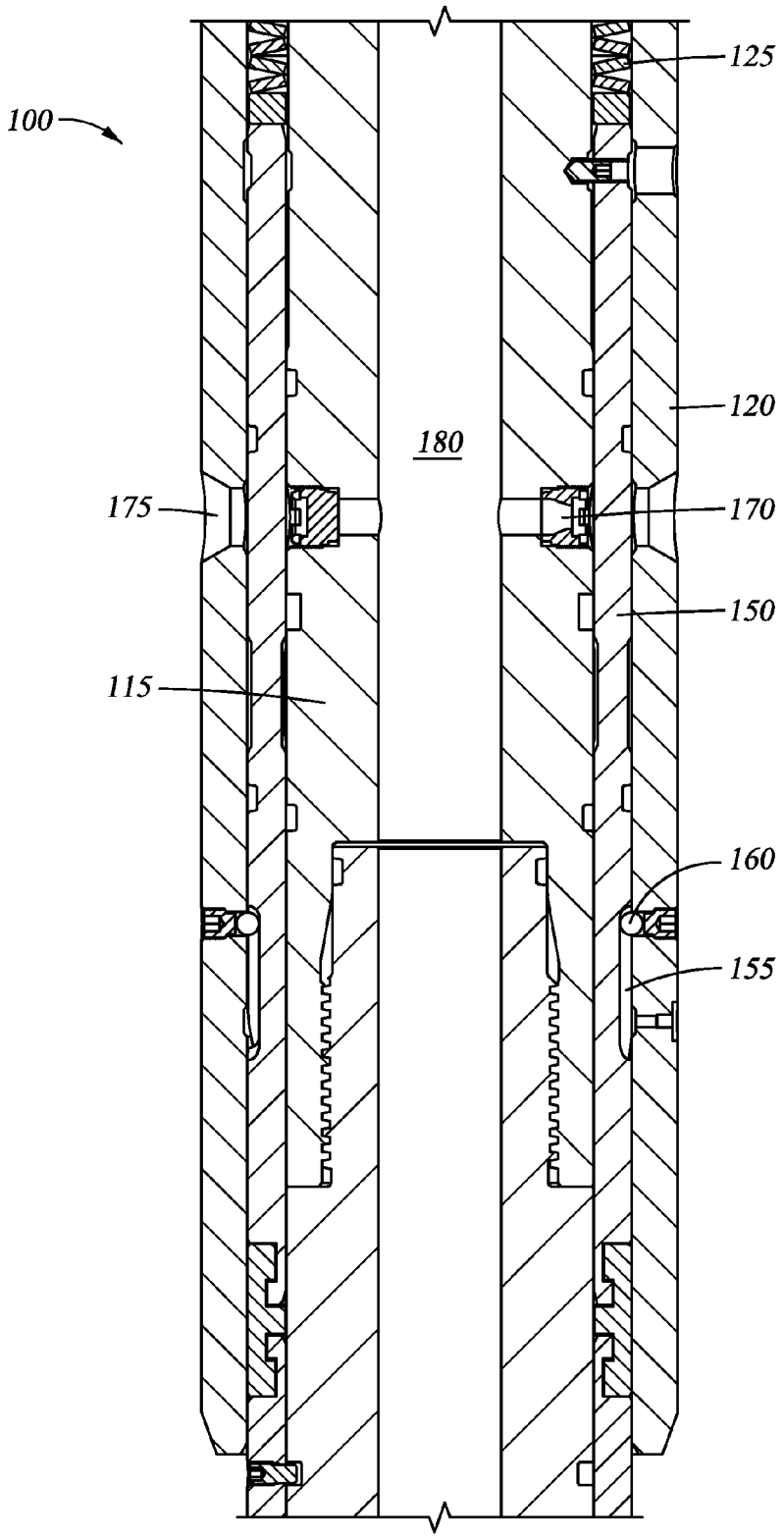

FIG. 2A is a partial section view of a lower end of the tool of FIG. 1 in an actuation position. The tool 100 is shown in an outer tubular 200 and in contact at a lower end with a smaller diameter tubular 300. An annular space 301 between the tubulars represents the annulus that is typically filled with cement. Debris to be cleaned by the tool typically comprises surplus cement that flows upwards from this annulus and dries on the upper surface of tubular 300 or the inner walls of larger diameter tubular 200. As is visible, the blade assembly 105 has been moved upwards relative to the body 115 and outer housing 120 by an actuation force developed between a lower end of the blades 110 and an upper surface of the tubular 300. The shearable pin 130 has been broken and the blade assembly 105 has compressed the spring 125 (FIG. 2B) and moved to a position in which the gap 152 previously formed between the leg of L-shaped member 153 and a lower end of the housing 120, no longer exists. Similarly, the pins 145 have moved to a lower position in the blade profiles 140. In addition, the blades 110 have moved to their outwardly extended position with the springs 135 biasing the blades 110 out and away from the body. While the blades are shown outwardly extended in FIG. 2A, it will be noted that the actuation force might create adequate friction between the blades 110 and tubular 300 that the blades remain in their retracted position while the actuation force is engaged.

Figure 2B:
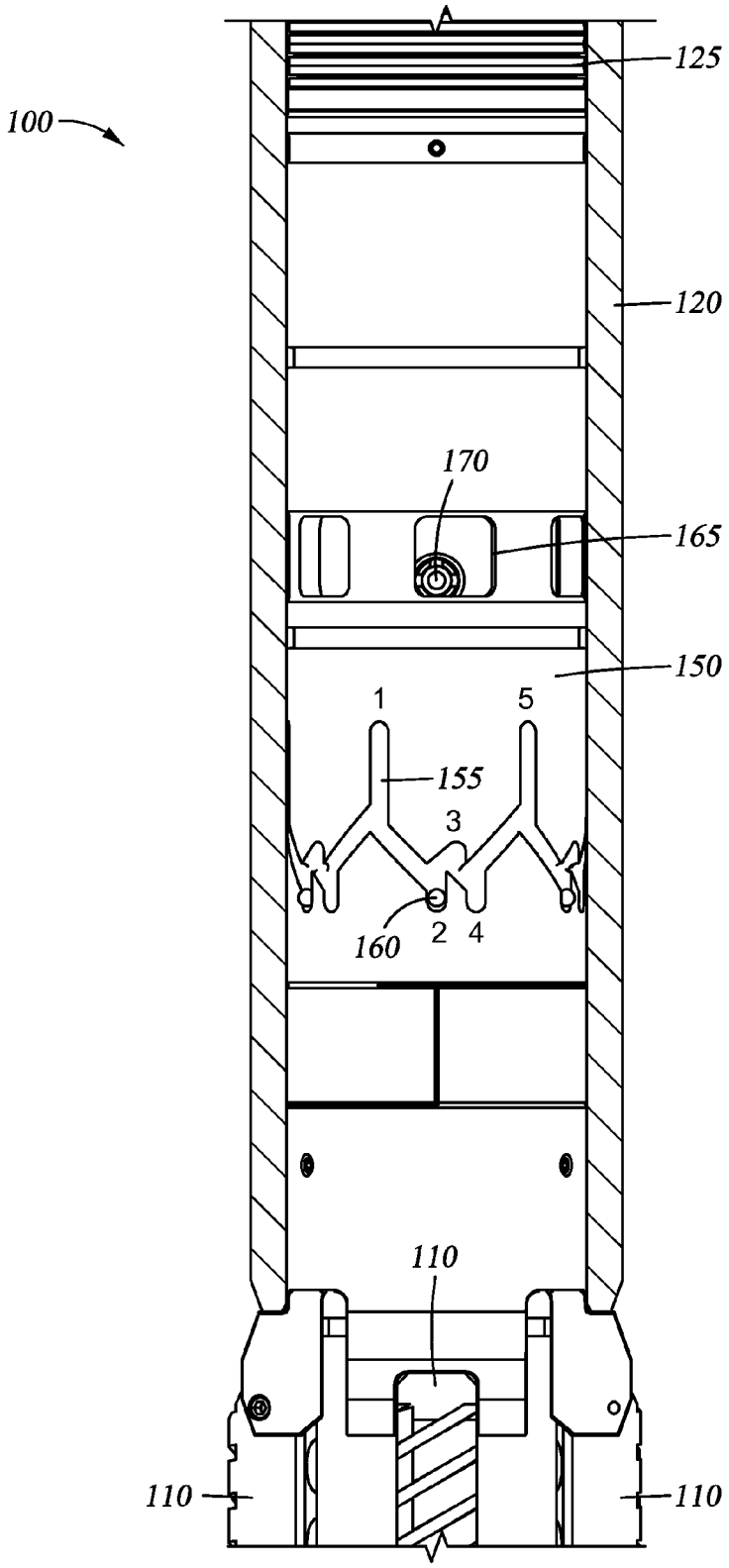

FIG. 2B, C are views of the upper portion of the tool 100 in the actuation position. Comparing FIG. 2B, C to FIG. 1B, C, the location of the inwardly facing balls 160 has changed relative to the continuous groove 155 of the indexer 150. Specifically, the balls 160 have moved from location "1" to location "2" as the indexer 150 has moved upwards relative to the body 115. The balls will remain in this position as long as the actuation force exists between the blades 110 and the tubular 300. Also visible in FIG. 2B, C is an alignment between the windows 165 of the indexer, the ports 170 of the body, and ports 175 of the outer housing (not visible in FIG. 2B) illustrating that fluid communication has been established between the bore 180 of the tool and an annular area between the tool 100 and the larger diameter outer tubular 200 with a resulting pressure drop that will notify the operator that the tool 100 is no longer in its run-in position. The alignment of the windows and ports is due to axial movement of the body and rotational movement of the indexer.

Figure 3A:
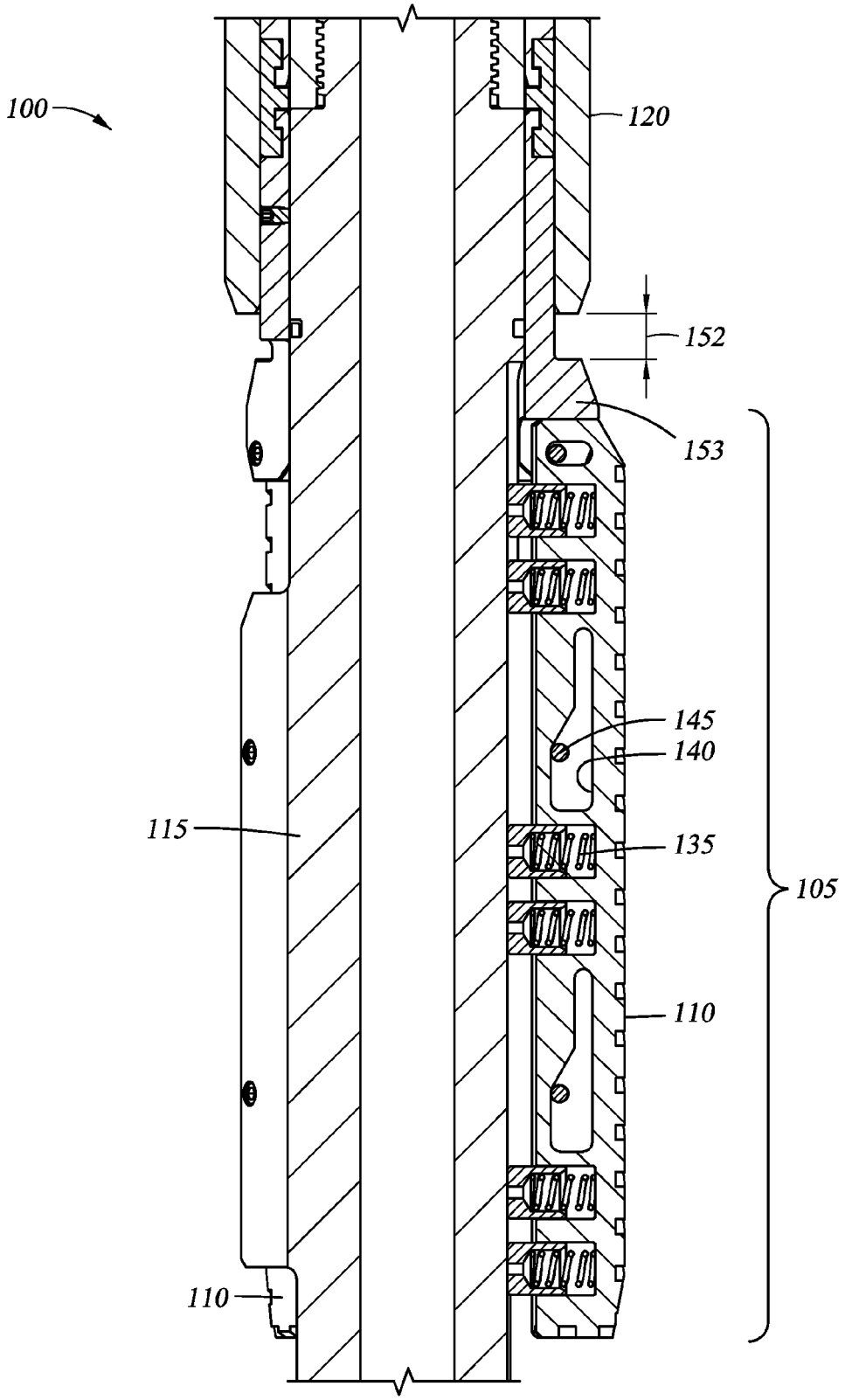
FIG. 3 A is a partial section view of a lower end of the tool in an operational position and FIG. 3 B, C are views of an upper portion thereof.
Figure 3B:
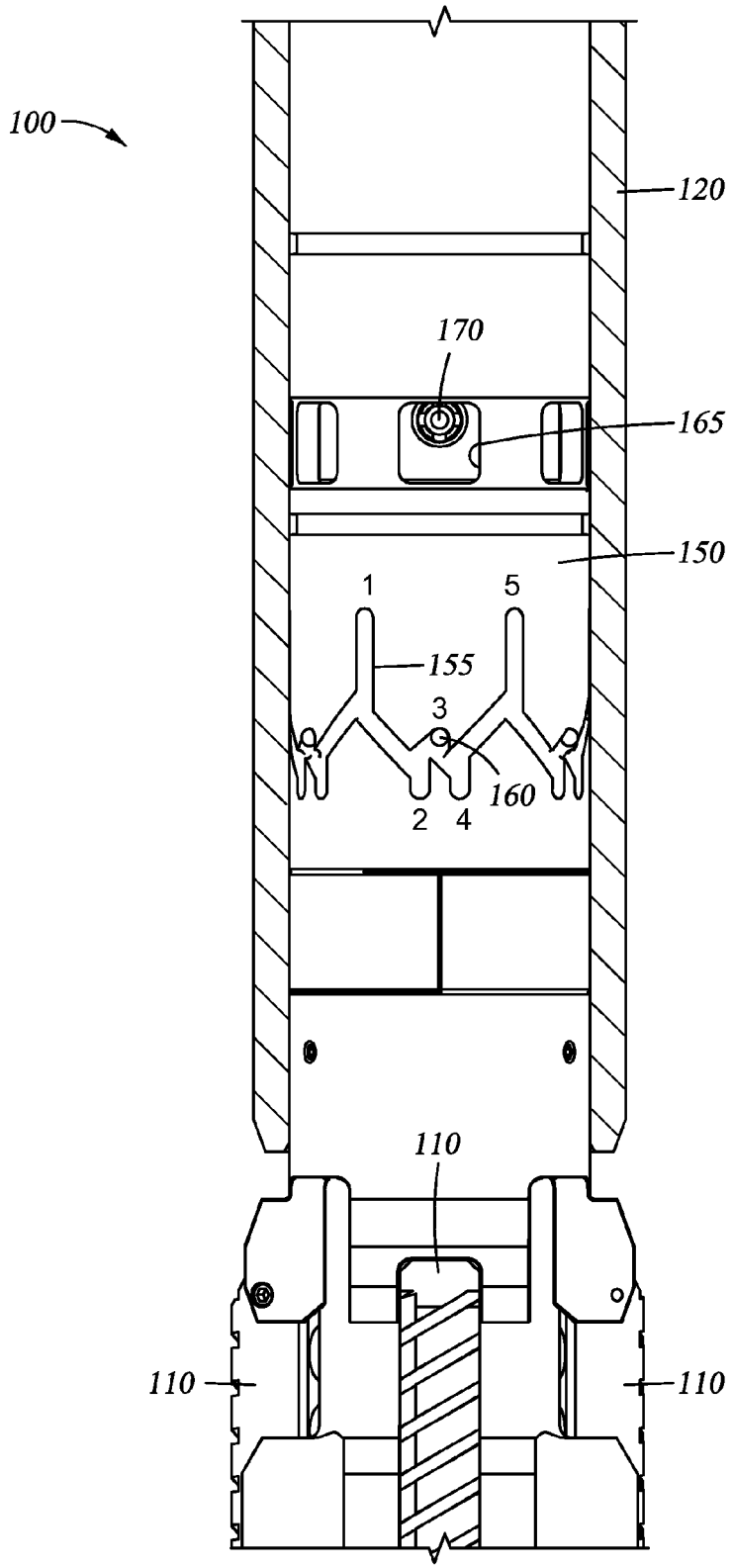
Figure 3C:
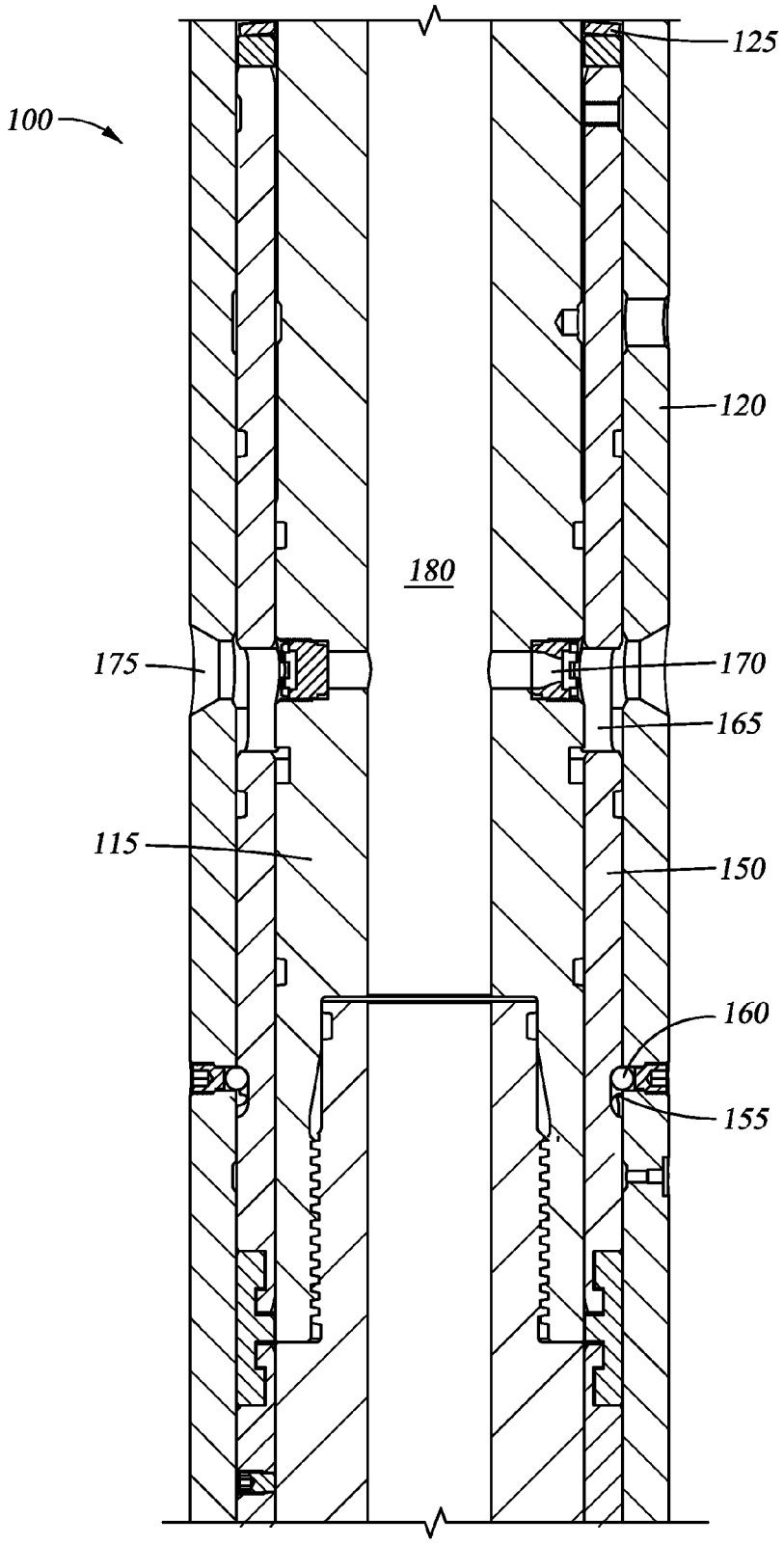

FIG. 3A is a section view of the tool 100 in its operating position. The blade assembly 105 is at a location along the body 115 between the run-in and actuation positions with the blades 110 outwardly extended and a partial gap 152 formed between the L-shaped member 153 and the outer housing 120. FIG. 3B is a partial section view of the upper portion of the tool 100 showing the indexer 150 with its continuous groove 155 and its relationship with the inwardly facing balls 160. In the operating position, the balls are located at location "3" on the indexer. In this position, the blade assembly 105 is held in place relative to the body 115 and outer housing 120 solely by the balls and the groove. As with the actuation position, in the operating position the windows of the indexer are aligned with the ports of the body and ports of the outer housing (FIG. 3C) producing a noticeable pressure drop.

One purpose of the indexer, with its inwardly facing balls and continuous groove is to permit the tool to be repeatably shifted between the run-in and operating positions. For example, from the run-in position (indexer location "1"), the tool is "set down" on a stationary object in order to generate an actuating force (indexer location "2"). Thereafter, as the tool is lifted off the tubular and the actuating force is relived, the tool moves to its operating position (indexer location "3"). If, in the course of using the tool in its operating position, an actuating force is inadvertently applied (moving balls to location 4) due to friction between the blade assembly and the side of the wellbore, for instance the indexer will move to the run-in position (location 5) and the operator will be notified due to a pressure increase as the window and ports are taken out of alignment. However, the continuous nature of the groove permits the tool to easily be reactivated by setting down weight and moving the balls from location 5 to the next set of locations that correspond to locations 2, 3, and 4. In this manner, the tool can be repeatedly shifted between run-in and operating positions.

Figure 4:
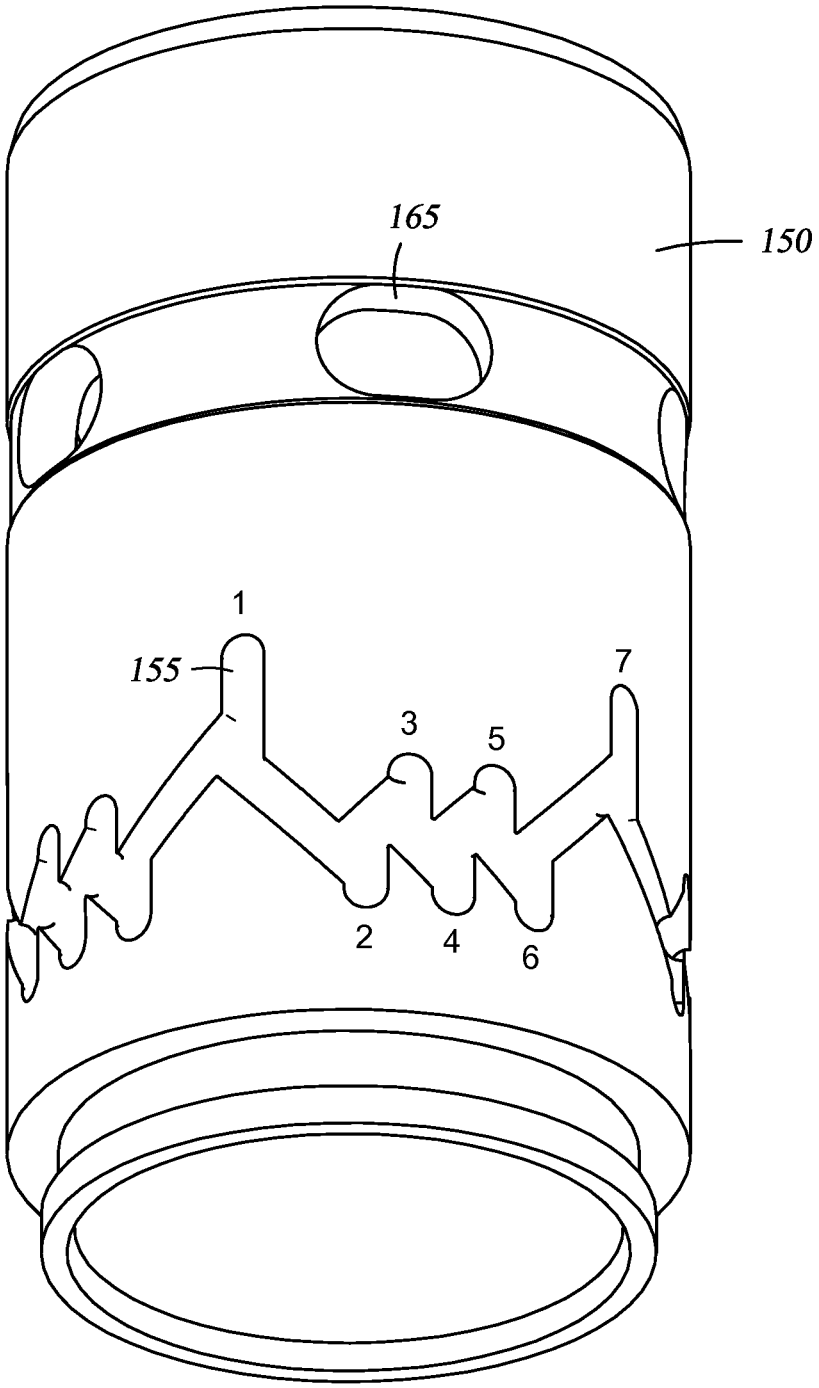
FIG. 4 is a perspective view of an indexer.

The embodiment discussed contemplates an indexer 150 with groove positions that shift the tool between the run-in and operation position with a single actuation force required between each movement. However, the indexer could be provided with a continuous groove that requires two separate actuating forces to return the tool to the run-in position. FIG. 4 is a perspective view of an indexer 150 with such a continuous groove 155 and the redundant operational position is shown by location 5 which is reached prior to a run-in position, shown as location 7. This embodiment ensures the tool will remain in an operating position even if an actuating force is inadvertently applied.

Figure 5:
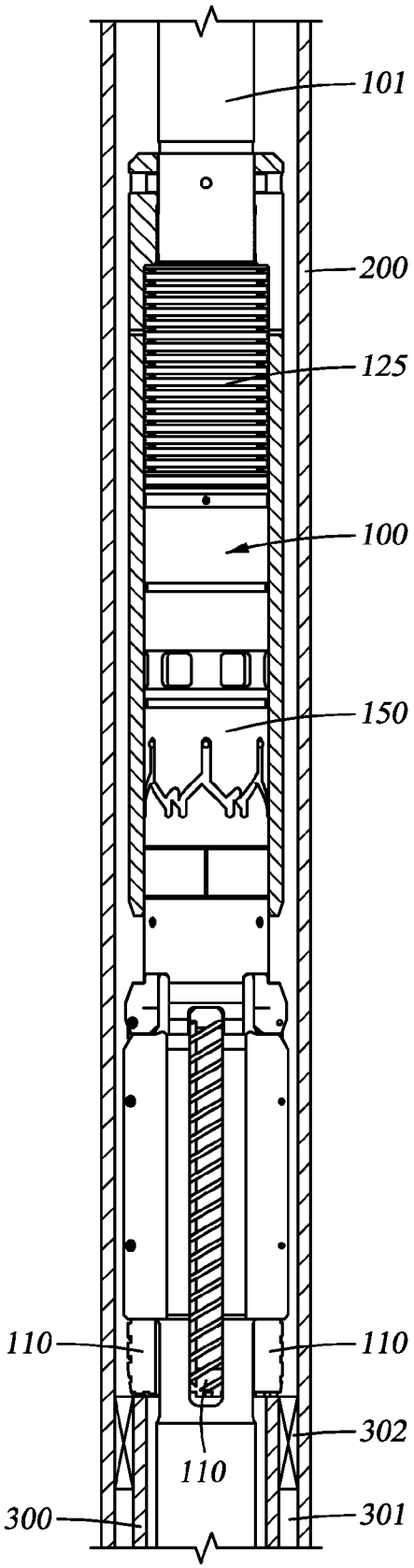
FIG. 5 is a partial section view of the tool in a wellbore.

FIG. 5 is a view of the tool 100 on a work string 101 in a wellbore. A larger diameter tubular (casing) 200 surrounds the tool 100 and below is an upper end of the smaller diameter tubular string 300. The tool is in the run-in position with the blades 110 in contact the lower casing just prior to "set down" and development of an actuation force. In FIG. 5, a packer or hanger is shown in the gap 301 between the two tubulars. The hanger permits the smaller diameter tubular string to be "hung" off the larger one while the smaller string is cemented in place.

Figure 2C:
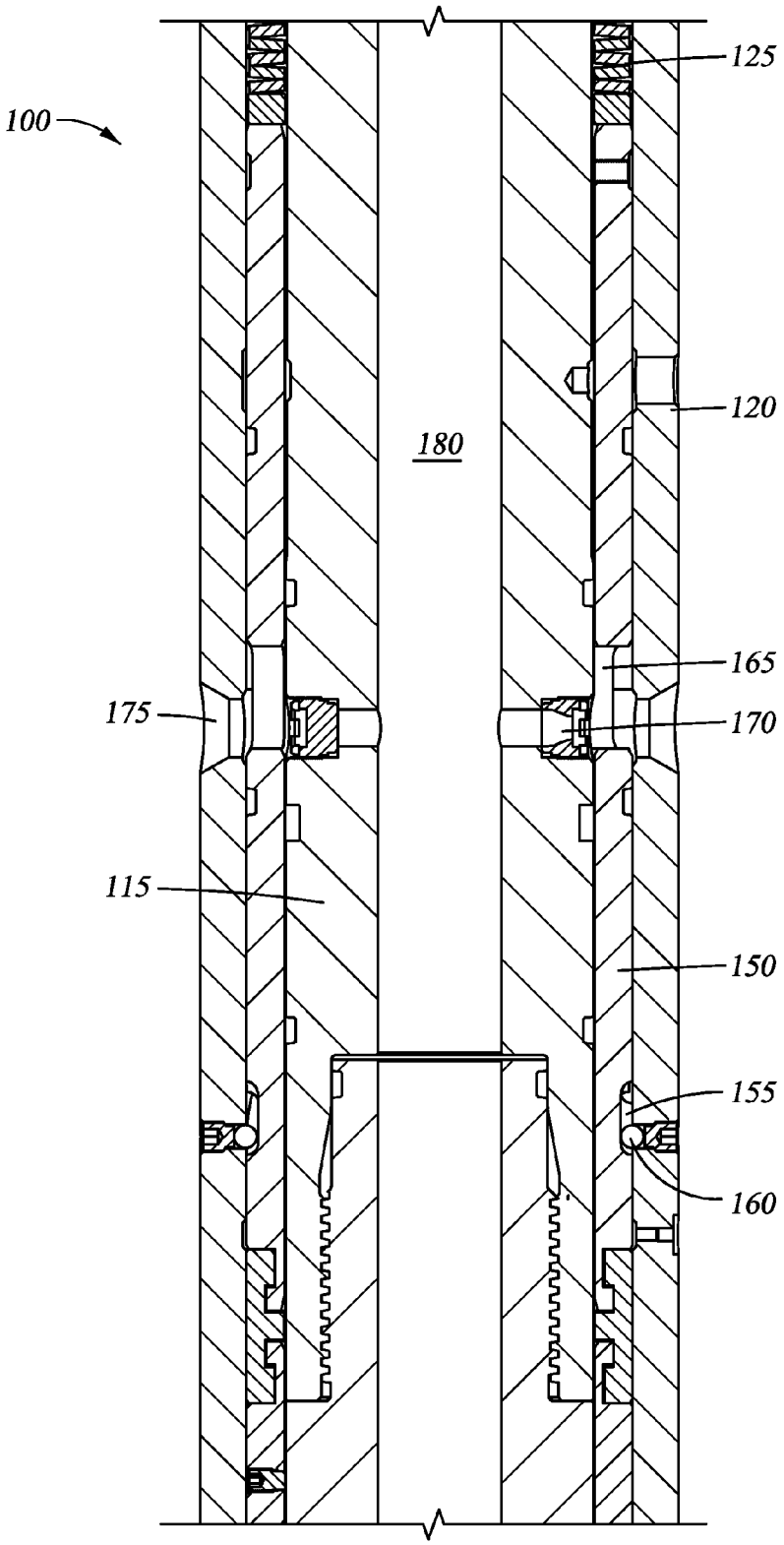

As the forgoing description and Figures illustrate, the tool 100 is run-in on a tubular string in a run-in position. When the tool reaches a junction between a larger diameter tubular string and a smaller diameter string therebelow, the tool is "set down" on the lower tubular to develop an actuation force. In the actuation position, the blades 110 may or may not be extended but in either case, a top surface of the lower tubular can be cleaned as the tool is rotated while in contact with the surface. Thereafter, the weight is removed and the tool moves to an operating position wherein the blades are extended as shown in FIGS. 2A-C. The tool can be rotated and reciprocated in the wellbore to remove debris while fluid is circulated to flush the debris to the surface with return fluid. To move the tool back to a run-in position, an actuation fore is again applied and then removed. Each time the tool moves from the run-in position, an accompanying pressure drop provides a signal to an operator. In one embodiment, debris can include debris created when the outer tubular is perforated and the blades can be equipped with abrasive and/or hardened material like tungsten carbide for that purpose.

In one embodiment, the tool 100 as it appears in FIG. 5 can be installed in a work string with any number of other tools and various downhole operations are performed in a single "run". For example, a single work string might include a bit at a lower end for drilling out a cement plug at the lower end of the newly cemented tubular string. By spacing the bit and the debris cleaning tool, the tool can be set down on the casing top and shifted to the operational position just after the plug is drilled out. In addition, metallic debris loosened by the tool can be collected with string magnets. Once the debris cleaning operation is complete, fluid may be circulated to flush the wellbore of any drilling mud and replace it with water. In the same run, using additional equipment in the work string, the well can be subjected to a negative pressure test. Thereafter, the debris removal tool can be returned to its run in position and tripped out of the well.

While the foregoing is directed to embodiments of the present invention, other and further embodiments of the invention may be devised without departing from the basic scope thereof, and the scope thereof is determined by the claims that follow.

The invention claimed is:

1. A downhole tool for use in a wellbore, comprising:

a tool body having a unitary blade assembly slidably mounted thereon, the blade assembly both axially movable relative to the tool body between an upper position and a lower position and radially movable relative to the blade body between a retracted position and an outwardly extended position;

wherein the blade assembly is biased towards the retracted position and the lower axial position, and movable to the extended position in response to an actuating force; and an indexer constructed and arranged to facilitate the movement of the blade assembly.

2. The downhole tool of claim 1, further including an indicating means to indicate the position of the blade assembly.

3. The downhole tool of claim 2, whereby the indicating means is a change in fluid pressure in the wellbore.

4. The downhole tool of claim 1, whereby the blade assembly is biased with a biasing member.

5. The downhole tool of claim 1, whereby the actuating force is an applied mechanical force on the blade assembly.

6. The downhole tool of claim 5, wherein the applied mechanical force is in an upward direction.

7. The downhole tool of claim 1, whereby the blade assembly includes at least three blades radially spaced about the tool body.

8. The downhole tool of claim 7, wherein the blades are usable for scraping.

9. The downhole tool of claim 7, wherein the blades are usable for cutting.

10. The downhole tool of claim 1, whereby the indexer is a cylindrical member movable rotationally in relation to the tool.

11. The downhole tool of claim 10, whereby the indexer is rotationally movable due to a continuous slot formed along an outer surface of the indexer and cooperation between the slot and a ball disposed in and movable relative to the slot.

12. The downhole tool of claim 11, wherein the tool is located in a work string.

13. The downhole tool of claim 12, wherein the tool is constructed and arranged to be reciprocated axially in the wellbore with the blade assembly in the extended position.

14. The downhole tool of claim 13, wherein the tool is initially retainable with the blade assembly in the retracted position by shear pins.

15. The downhole tool of claim 1, wherein the indexer requires at least two separate actuating force applications to move the blade assembly from the extended position to the retracted position.

16. The downhole tool of claim 1, wherein the blade assembly is both axially and radially movable regardless of fluid pressure in the tool.

17. The downhole tool of claim 1, wherein the blade assembly is in the outwardly extended position when the blade assembly is in the upper position.

18. The downhole tool of claim 1, wherein the indexer is rotatable in response to axial movement of the blade assembly.

19. A method of cleaning a wellbore, comprising:

running a downhole tool to a predetermined depth in the wellbore, the wellbore having a fixed tubular member below the predetermined depth and the downhole tool having a tool body with a movable blade assembly, wherein the blade assembly is initially biased towards a radially retracted position;

actuating the blade assembly a first time by engaging the blade assembly with the fixed tubular member such that the blade assembly moves axially and radially relative to the tool body from the radially retracted position to a radially extended position;

actuating the blade assembly a second time; and actuating the blade assembly a third time by engaging the blade assembly with the fixed tubular member, thereby moving the blade assembly to the radially retracted position.

20. The method of claim 19, wherein the tool is reciprocated axially in the wellbore before actuating the blade assembly the second time.

21. The method of claim 19, whereby the tool is reciprocated in the wellbore between actuating the blade assembly the second and third time.

22. The method of claim 19, wherein the blade assembly is biased towards the radially extended position after moving axially from the radially retracted position.

23. The method of claim 19, wherein actuating the blade assembly the second time includes engaging the blade assembly with the tubular member.

24. The method of claim 19, wherein the blade assembly remains in the extended position when actuating the blade assembly the second time.

25. The method of claim 19, wherein the blade assembly is biased towards a lower position when in the retracted position.

26. A downhole tool for use in a wellbore, comprising:

a tool body having a blade assembly slidably mounted thereon, the blade assembly both axially movable and radially movable relative to the tool body between a retracted position and an outwardly extended position;

wherein the blade assembly is biased towards the retracted position and the lower axial position, and movable to the extended position in response to an actuating force; and an indexer constructed and arranged to require at least two separate actuating force applications to move the assembly from the extended position to the retracted position.

27. The downhole tool of claim 26, wherein the blade assembly is both axially and radially movable regardless of fluid pressure in the tool.

* * * * *